US008335459B2

(12) United States Patent
Joppen

(10) Patent No.: US 8,335,459 B2
(45) Date of Patent: Dec. 18, 2012

(54) METHOD FOR OPERATING AN IMAGE-FORMING DEVICE AND AN IMAGE FORMING DEVICE FOR APPLICATION OF THE METHOD

(75) Inventor: Sandor H. G. Joppen, Grubbenvorst (NL)

(73) Assignee: Oce-Technologies B.V., Venlo (NL)

( * ) Notice: Subject to any disclaimer, the term of this patent is extended or adjusted under 35 U.S.C. 154(b) by 5 days.

(21) Appl. No.: 13/155,792

(22) Filed: Jun. 8, 2011

(65) Prior Publication Data

US 2011/0236050 A1 Sep. 29, 2011

Related U.S. Application Data

(63) Continuation of application No. PCT/EP2009/067397, filed on Dec. 17, 2009.

(30) Foreign Application Priority Data

Dec. 23, 2008 (EP) ..... 08172801

(51) Int. Cl.
*G03G 15/09* (2006.01)

(52) U.S. Cl. ..... 399/273; 399/53; 399/71; 399/149; 399/267

(58) Field of Classification Search ..... 399/273, 399/267, 149, 71, 53
See application file for complete search history.

(56) References Cited

U.S. PATENT DOCUMENTS

| | | | | |
|---|---|---|---|---|
| 3,946,402 | A | 3/1976 | Lunde | |
| 5,768,666 | A * | 6/1998 | Ito et al. | 399/273 |
| 7,680,426 | B2 * | 3/2010 | Fujimori | 399/53 |
| 2007/0140740 | A1 | 6/2007 | Kweon et al. | |

FOREIGN PATENT DOCUMENTS

| | | | |
|---|---|---|---|
| EP | 57-165865 | A | 10/1982 |
| EP | 0 304 983 | B1 | 3/1992 |
| EP | 0 718 721 | A1 | 6/1996 |
| WO | WO 92/22911 | A1 | 12/1992 |

OTHER PUBLICATIONS

PCT/ISA/237 Written Opinion of PCT/EP2009/067397, dated Apr. 9, 2010.

* cited by examiner

*Primary Examiner* — Sophia S Chen
(74) *Attorney, Agent, or Firm* — Birch, Stewart, Kolasch & Birch, LLP

(57) ABSTRACT

A method for selectively removing magnetically attractable toner particles from an image-forming device and an image-forming device for performing the same are provided. The image-forming device includes a cleaning magnet system, configured to provide an activatable second magnetic field. The method includes a step of switching the image-forming device into a cleaning mode, the cleaning mode including the steps of stopping the toner supply to the image-recording medium, rotating the rotatable sleeve in a second direction, opposite to the first direction, such that the magnetically attractable toner particles are transported out of the developing zone towards the cleaning magnet system, and activating the second magnetic field so as to remove the transported magnetically attractable toner particles from the rotating rotatable sleeve of the developing element.

9 Claims, 3 Drawing Sheets

Figure 1:
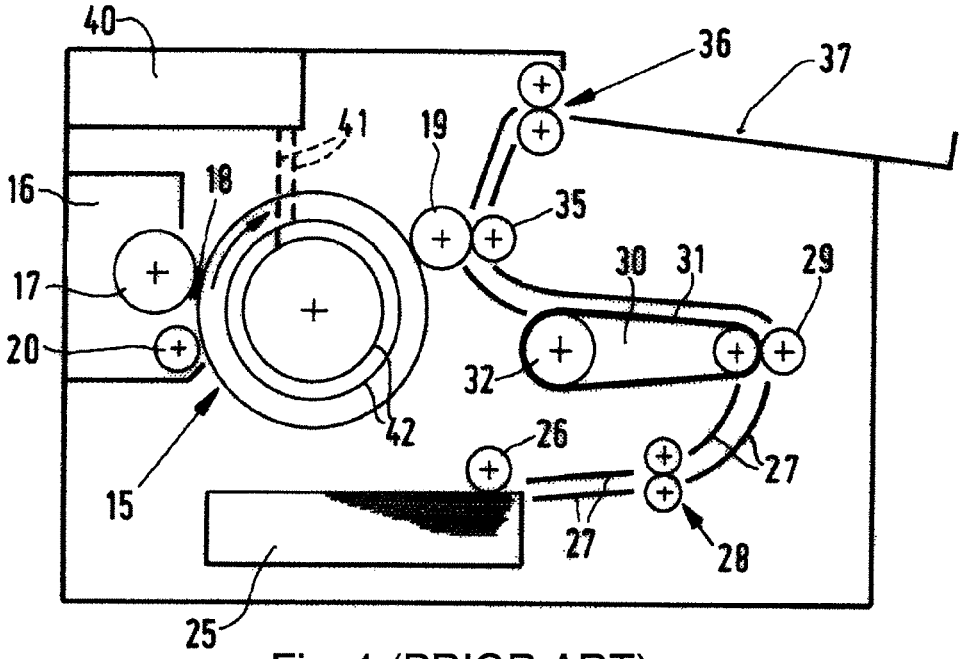
Fig. 1 (PRIOR ART)

METHOD FOR OPERATING AN IMAGE-FORMING DEVICE AND AN IMAGE FORMING DEVICE FOR APPLICATION OF THE METHOD

This application is a Continuation of PCT International Application No. PCT/EP2009/067397 filed on Dec. 17, 2009, which designated the United States, and on which priority is claimed under 35 U.S.C. §120. This application also claims priority under 35 U.S.C. §119(a) on Patent Application No. 08172801.6 filed in the European Patent Office on Dec. 23, 2008. The entire contents of each of the above documents is hereby incorporated by reference into the present application.

The present invention relates to a method for operating an image-forming device, the image-forming device comprising an image-recording medium, a toner supply roller arranged for supplying toner particles to the image-recording medium, a developing element comprising a rotatable sleeve and an internal stationary magnet system generating a first magnetic field, and a cleaning magnet system, configured to provide an activatable second magnetic field, the image-forming device being operable in a printing mode wherein the toner supply roller supplies toner particles to the image-recording medium, the rotatable sleeve rotates in a first direction so as to form a toner assembly in a developing zone by an interaction between the magnetically attractable toner particles and the first magnetic field generated by the stationary magnet system, while removing excessive toner and transporting the same back to the toner supply roller, and the image-recording medium forms a toner image on the image-recording medium in the developing zone by selectively electrically attracting toner particles onto the image-recording medium in accordance with a digital image pattern.

An Image-forming method (i.e. method performed in the printing mode) and image-forming device being operable in a printing mode are described inter alia in European patent 0718721. In this patent, a toner powder image formed in an image-forming zone on the surface of an image-recording medium is transferred directly or indirectly via an intermediate medium to a receiving material, such as plain paper, and fixed thereon. The image-recording medium is then used again for the next image-recording cycle. The image-forming method (i.e. method performed in the printing mode) and image forming device being operable in a printing mode is described in more detail in FIG. 1, FIG. 2 and FIG. 3.

A disadvantage of the known image-forming device is that in the printing mode coarse toner particles are being captured in the toner assembly which is formed in the developing zone. Coarse toner particles in the sense of the present invention are toner particles having a size, larger than the average particle size of the toner powder, such that the magnetic force exerted on a toner particle by the stationary magnet system of the developing element may be equal or larger than the electric force exerted in a substantially opposite direction by an energized image-forming electrode. Such toner particles are also referred to as 'non-printable' toner particles, because they cannot escape from the magnetic field of the stationary magnet system of the developing element. Coarse toner particles will therefore accumulate in the toner assembly which may eventually lead to 'white stripe marks' (i.e. regions on the image-recording medium where no toner is printed) on the image-recording medium in the rotation direction of the image-recording medium and thus to an inferior print quality.

Toner production processes may be the cause that coarse toner particles are inherently present in the toner powder. Coarse toner particles may also be formed by aggregation of smaller toner particles.

Coarse toner particles may be cleaned from the known image-forming device by stopping the toner supply from the toner supply roller to the image-recording medium and rotating the sleeve of the developing element in the first direction such that toner particles may be transported back to the toner supply roller until the toner assembly in the development zone is completely broken down.

A disadvantage of this cleaning method is that the 'non-printable' coarse toner particles are transported back to the toner supply roller. Because coarse toner particles are not permanently removed from the image-forming device, such particles will accumulate in the image-forming device and will eventually lead to 'white stripe marks' again. Due to the increasing concentration of coarse toner particles in the image-forming device, the frequency of occurrence of 'white stripe marks' will increase over time.

It is an object of the present invention to provide a method for selectively removing magnetically attractable toner particles from the image-forming device.

This object is achieved by the method according to the preamble, the image-forming device comprising a cleaning magnet system, configured to provide an activatable second magnetic field, the method comprising a step of switching the image-forming device into a cleaning mode, the cleaning mode comprising:

stopping the toner supply to the image-recording medium;

rotating the rotatable sleeve in a second direction, opposite to the first direction, such that the magnetically attractable toner particles are transported out of the developing zone towards the cleaning magnet system; and activating said second magnetic field so as to remove the transported magnetically attractable toner particles from the rotating sleeve of the developing element.

The toner particles may be permanently removed from the image-forming device by deactivating the cleaning magnet system, such that the removed toner particles are collected in a toner collecting bin.

In an embodiment, the rotatable sleeve is rotated in the first direction during a pre-determined amount of time prior to rotating the rotatable sleeve in the second direction. An advantage of this embodiment is that first printable toner particles (i.e. normally sized toner particles) which are still present in the toner assembly in the developing zone may be transported back to the toner supply roller. The magnetic interaction between the stationary magnet system of the developing sleeve and coarse toner particles is stronger than the magnetic interaction between the stationary magnet system and normally sized toner particles. Due to this stronger interaction, coarse toner particles will be captured in the toner assembly for a longer time. Eventually, coarse toner particles will also be transported back to the toner supply roller. The rotatable sleeve may be rotated in the first direction during a pre-determined time, which is just long enough to transport normally sized toner particles back to the toner supply roller and short enough to prevent coarse toner particles to be transported back to the toner supply roller. This method thus provides a step which enables selective removal of coarse toner particles from the developing element of an image-forming device, by first concentrating the coarse toner particles in the toner assembly and then removing them in the subsequent steps of the method.

In another embodiment the second magnetic field is generated by positioning a movable arranged permanent magnet near the rotatable sleeve.

In another embodiment the second magnetic field is generated by activating an electro-magnetic activatable magnet system.

The present invention also relates in another aspect to an image forming device, the image forming device comprising an image-recording medium, a toner supply roller arranged for supplying toner particles to the image-recording medium, a developing element comprising a rotatable sleeve and an internal stationary magnet system generating a first magnetic field, a cleaning magnet system, configured to provide an activatable second magnetic field, and a controller configured to switch the image-forming device into a cleaning mode so as to stop the toner supply, to rotate the rotatable sleeve in a second direction and to activate the cleaning magnet system.

In an embodiment the activatable cleaning magnet system is a moveable permanent cleaning magnet, which for example comprises a roller on which a permanent cleaning magnet is arranged. The moveable permanent cleaning magnet system may be activated by moving the permanent cleaning magnet from an idle position to an active position, for example by rotating the roller from an idle to an active position. In the idle position the magnet system is arranged such that the magnetic field of the permanent cleaning magnet does not influence the printing process. In the active position, toner particles are collected under the influence of the magnetic field of the permanent cleaning magnet.

In another embodiment the cleaning magnet system is an electro-magnet which may be activated by energizing the electro-magnet.

In another embodiment the activatable cleaning magnet system and the developing element are arranged such that they are separated by a solid wall. This particular arrangement has the advantage that the cleaning magnet system remains free of toner and does not need to be cleaned. The waste toner remains inside the frame and may be removed by an operator.

In another embodiment the image-forming device comprises a toner collecting bin. The toner collector bin may be formed by a wall of a frame which holds the image forming device. The presence of a collector bin prohibits the waste toner from re-entering the image-forming process.

Figure 2:
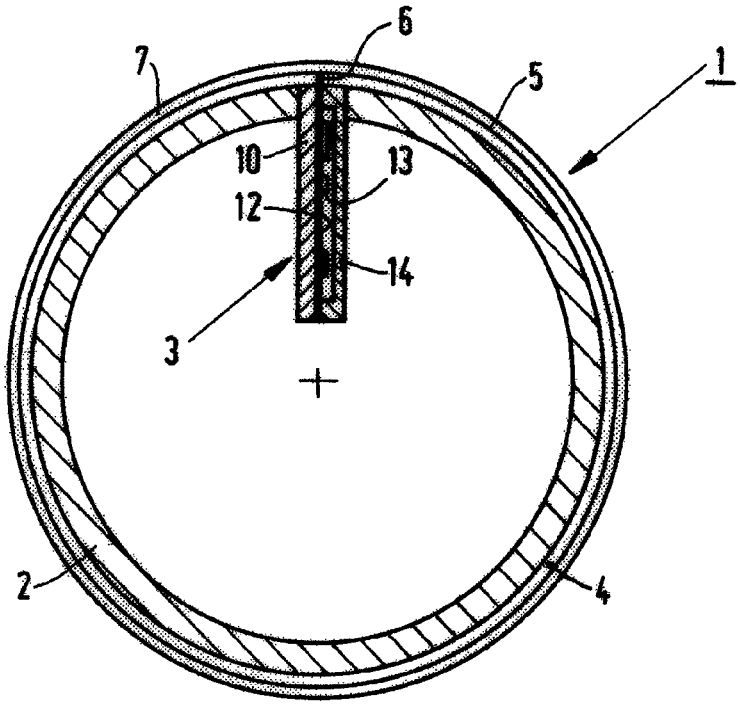
Figure 3:
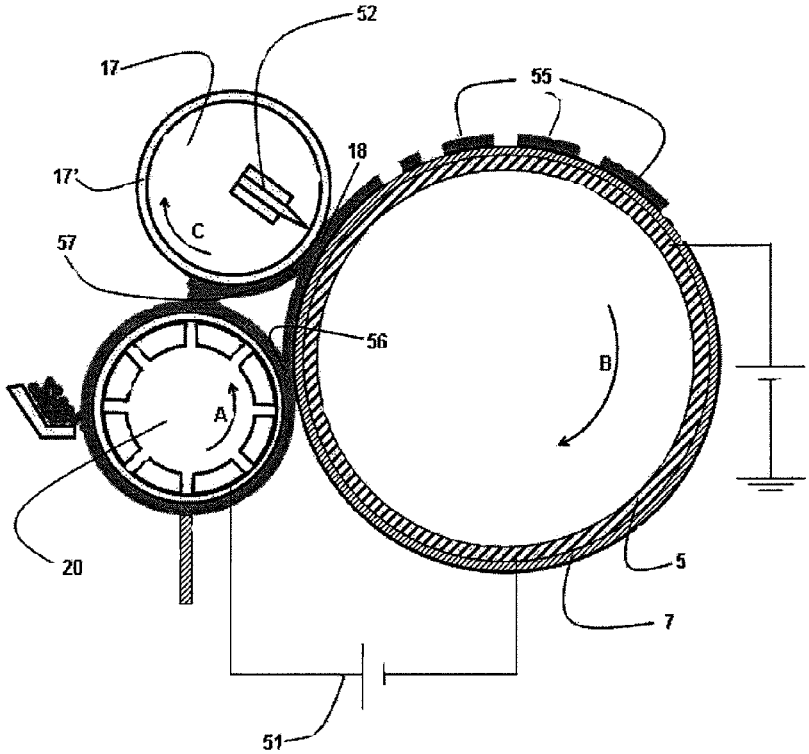
Figure 4:
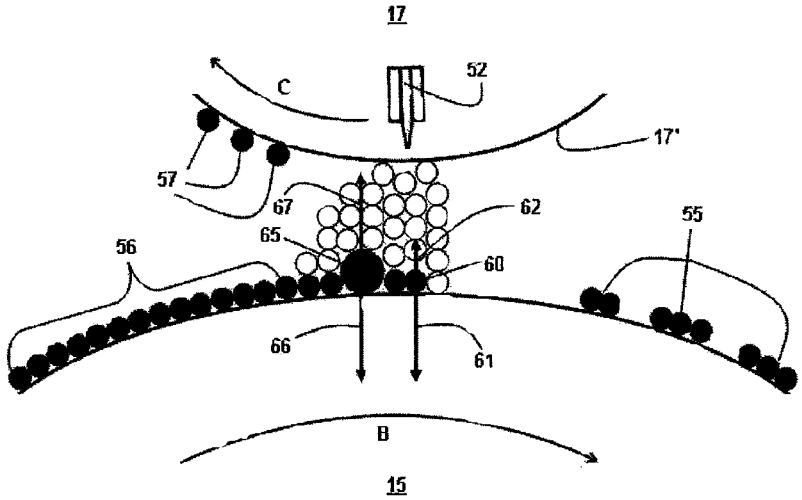
Figure 5:
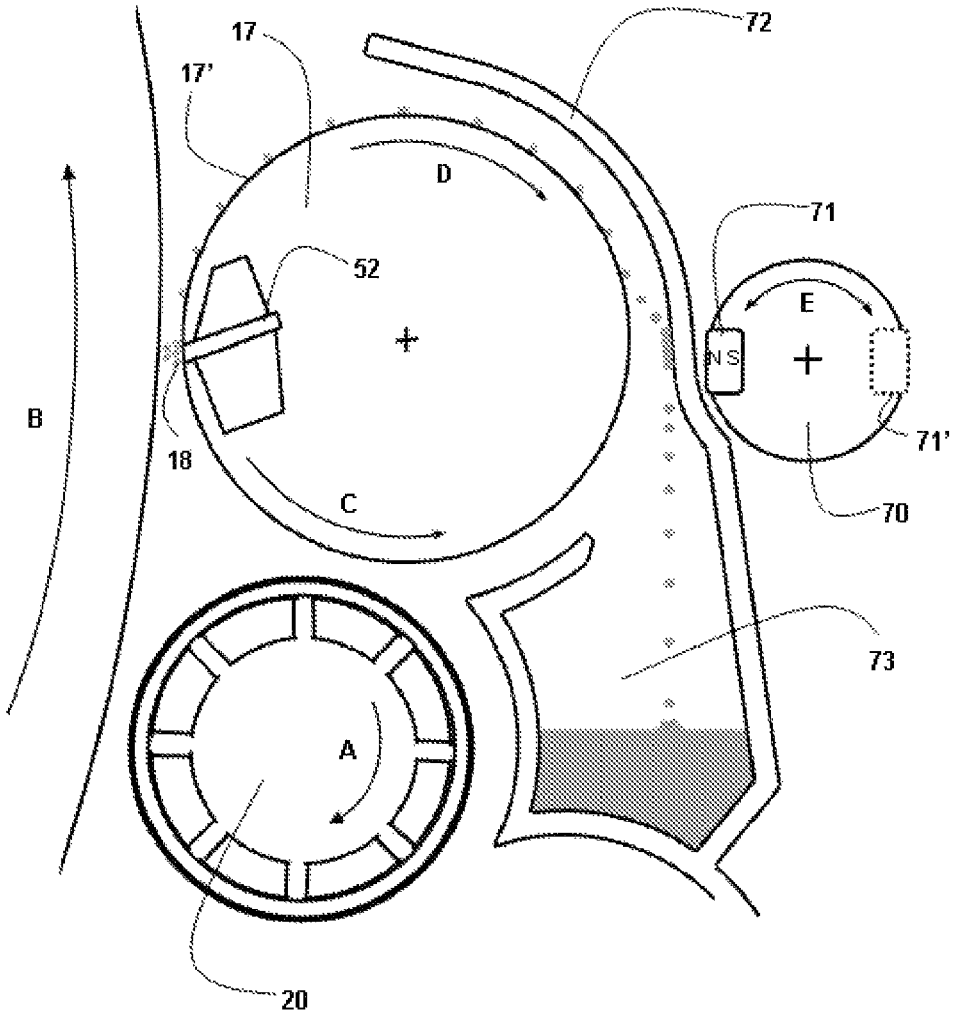

The invention is explained in detail with reference to the following description and accompanying drawings wherein:

FIG. 1 diagrammatically illustrates an image-forming device according to the prior art;

FIG. 2 is a section of an image-recording medium as used in the device shown in FIG. 1;

FIG. 3 diagrammatically illustrates a portion of the image-forming device of FIG. 1 in a printing mode;

FIG. 4 diagrammatically illustrates a toner assembly in the image-forming zone; and FIG. 5 diagrammatically illustrates a lay-out of an image-forming device according to the present invention in a cleaning mode The image-forming device shown in FIG. 1 is provided with the image-recording medium 15 which will be described in detail hereinafter with reference to FIG. 2. The image-recording medium 15 passes through an image-forming station 16 where its surface is provided with a uniform layer of toner powder of a resistivity of about $10^5$ Ωm, by means 20 constructed as described in U.S. Pat. No. 3,946,402.

The powdered surface of the image-recording medium 15 is then fed to an image-forming zone 18 where a magnetic roller 17 is disposed a short distance from the surface of the medium 15 and comprises a rotatable electrically conductive sleeve and a stationary magnet system disposed inside the sleeve. The stationary magnet system comprises for example a ferromagnetic knife blade clamped between like poles of two magnets and is constructed as described in EP 0 304 983. Another type of stationary magnet system is described in EP 0 718 721 and comprises two oppositely magnetized areas separated by a gap. By applying a voltage between one or more image-forming electrodes of the image-recording medium 15 and the magnetic roller sleeve acting as a companion electrode, a powder image is formed on the image-recording medium. By the application of pressure this powder image is transferred to a heated rubber-coated roller 19. A sheet of paper is taken from the supply stack 25 by a roller 26 and is fed via belts 27 and rollers 28 and 29 to a heating station 30. The latter comprises a belt 31 trained around a heated roller 32. The paper sheet is heated by contact with the belt 31. The sheet of paper thus heated is now passed between the roller 19 and the pressure roller 35, the softened powder image on the roller 19 being completely transferred to the sheet of paper. The temperatures of the belt 31 and the roller 19 are so adapted to one another that the image fuses to the sheet of paper. The sheet of paper provided with an image is fed via conveyor rollers 36 to a collecting tray 37. Unit 40 comprises an electronic circuit which converts the optical information of an original into electrical signals which are fed, via wires 41 provided with sliding contacts, and via conductive tracks 42 formed in the side wall of the image-recording medium 15, to control elements 3 (see FIG. 2) connected to the tracks 42. The information is fed serially line by line to the shift register of the integrated circuits of the elements 3. If the shift registers are completely full in accordance with the information of one line, that information is set in the output register and the electrodes 6, 5 (see FIG. 2) are energized or not via the drivers depending on the signal. While this line is being printed, the information of the next line is fed to the shift registers. Unit 40 also comprises the known control electronics for controlling, regulating and monitoring the various functions of the image-forming device.

Electrical signals originating from a computer or a data-processing device can be converted in unit 40 to signals fed to the control elements 3.

The image-recording medium 15 used in the image-forming device of FIG. 1 is shown in diagrammatic cross-section in FIG. 2. The image-recording medium 15 shown in FIG. 2 comprises a cylinder 2 and disposed therein an axially extending control element 3 having a construction to be described hereinafter. The cylinder 2 is covered with an insulating layer 4, on which image-forming electrodes 5 are disposed and extend in the form of endless tracks parallel to one another at substantially constant spacing from one another in the peripheral direction of the cylinder 2. Each image-forming electrode 5 is conductively connected to one control electrode 6 in each case of the control element 3. The number of control electrodes 6 of the control element 3 is equal to the number of image-forming electrodes 5, such number determining the quality of images to be formed on the image-recording element 1. The greater the electrode density, the better the image quality. Exemplary, the number of electrodes 5 is 16 per millimeter, the electrodes 5 having a width of 40 μm and the inter-electrode distance being about 20 μm. Other ways of conductively connecting the image-forming electrodes 5 to the control electrodes 6 may be used for example to improve the image quality (line resolution) by allowing the density of the image-forming electrodes 5 to be higher than the density of the control electrodes 6.

Finally, the pattern of image-forming electrodes 5 is covered with a smooth dielectric top layer 7 consisting of an approximately 0.8 micrometer thick layer of silicon oxide. The control element 3 comprises a support 10 provided in a known manner with an electrically conductive metal layer (such as copper), the metal layer being converted to a conductive track pattern 12 in known manner. The track pattern 12 consists, on the one hand, of the conductive connections between the various electronic components 13 of the control element 3 and, on the other hand, the control electrodes 6 each conductively connected to one image forming electrode 5 in each case. Finally, the control element 3 also comprises a cover 14 connected in manner known per se (e.g. gluing) to the support 10 so that a box-shaped control element 3 is formed, in which the electronic components are enclosed.

The electronic components 13 comprise a number of known integrated circuits (IC's) comprising a series-in parallel-out shift register, an output register, and drivers connected thereto with a voltage range of 25 to 50 volts. Each control electrode 6 is connected to a driver of one of the integrated circuits.

FIG. 3 is a schematic drawing of a portion of the image-forming device of FIG. 1 in a printing mode. In the printing mode, the toner supply roller 20, the image recording medium 15 and the sleeve 17' of the developing element 17 rotate in the directions as indicated by arrows A, B and C respectively. By applying a voltage 51 between the supply roller 20 and the image recording medium, a layer of toner 56 is supplied to the image recording medium 15. The powdered surface of the image-recording medium 15 is then fed to an image-forming zone 18 where a magnetic roller 17 is disposed a short distance from the surface of the medium 15 and comprises a rotatable electrically conductive sleeve 17' and a stationary magnet system 52 as described before disposed inside the sleeve.

In the printing mode a toner assembly is formed in the image forming zone 18, as shown in FIG. 4. For clarity reasons some toner particles are represented by white circles. They are in fact identical to the toner particles represented by the black circles. By applying a voltage between one or more image-forming electrodes 5 of the image-recording medium 15 and the magnetic roller sleeve acting as a companion electrode, toner particles experience an electric force towards the image-recording medium and a magnetic force towards the sleeve of the developing element, the latter induced by stationary magnet system 52. For normally sized toner particles (e.g. the particle in FIG. 4 indicated with number 60), which are exemplary smaller than 25 μm, the electric force 61 exceeds the magnetic force 62, which causes the toner particle to be printed, i.e. attracted by the image-recording medium. Toner particles that are present on an image-forming electrodes that is not energized (i.e. no voltage being applied) only experience the magnetic force induced by the stationary magnet system and are cleaned from the image-recording medium and transported back to the toner supply unit 20 (toner particles indicated with number 57 in FIGS. 3 and 4). A powder image may be formed on the image-recording medium according to an image pattern (see 55 in FIGS. 3 and 4).

Coarse toner particles (e.g. the particle in FIG. 4 indicated with number 65) which are present in the toner supply may disturb the image formation process. Such particles may inherently be present in toner supplies due to the production process of toner or may be aggregates of smaller toner particles. Such particles eventually end up in the toner assembly, just like normal toner particles in a way as described above. However, when a voltage is applied between an image-forming electrode and the companion electrode where at that moment a coarse particle is situated, there may exist a balance between the electric force 66 and the magnetic force 67 exerted on the coarse particle, such that it cannot be printed. Due to strong magnetic interactions between coarse toner particles and the stationary magnet system of the developing element, such particles are also not removed by the rotation of the sleeve 17' back to the toner supply.

Such coarse toner particles need to be removed from the image-forming device, in particular out of the image-forming zone 18. FIG. 5 diagrammatically illustrates a lay-out of an image-forming device according to the present invention in a cleaning mode. In this particular embodiment a roller 70 comprising a cleaning magnet 71 is arranged outside the frame of the image forming device. As an alternative for this particular arrangement, an otherwise moveable permanent magnet may be used. Yet another alternative comprises an electro-magnet system that is energized in the cleaning mode.

The frame 72 has been shaped such that a toner waste bin 73 is formed.

The cleaning mode involves the following steps:

- stopping the toner supply to the image-recording medium by shutting off the voltage 51 between the supply roller 20 and the image recording medium 15.
- optionally the sleeve 17' of the developing element 17 may be rotated in the direction indicated by arrow C, such that toner particles of normal size are transported back to the toner supply roller and eventually to the toner supply.
- the cleaning magnet system is activated, in this embodiment by bringing the magnet in the cleaning position as indicated by double arrow E and the solid image of the permanent magnet in FIG. 5.
- the rotation direction of the sleeve of the developing element is reversed as indicated by arrow D, such that the remaining toner particles in the toner assembly are transported towards the cleaning magnet, without being captured by the magnetic toner supply roller. When the toner particles come in the influence of the magnetic field of the cleaning magnet they will jump from the developing sleeve towards the frame wall of the image forming device, where the toner particles are collected.
- Finally the cleaning magnet system is deactivated, in this embodiment by bringing the magnet back in its idle position, as indicated by double arrow E and the ghost image 71' of the magnet in FIG. 5. The waste toner particles are dropped in the waste bin.

With the above described method coarse toner particles may be selectively removed from the image-forming device, such that they do not end up in the toner supply and thus the concentration of coarse particles in the toner supply does not increase over time.

The method according to the invention can be used, e.g. with toner powders having an electrically conductive surface coating consisting, for example, of carbon, a doped metal oxide such as tin oxide doped with fluorine or antimony, or a conductive polymer such as protonized polyaniline complex, such as known from WO 92/22911, or with electrically conductive toner powders which have obtained their conductivity by electrically conductive material, e.g. the above-mentioned protonized polyaniline complexes, being distributed over the volume of the toner particles. A toner powder of this kind can be obtained, for example, by melting 100 g of polyester resin as described above, then distributing 11 g of protonized complex of polyaniline emeraldine and camphorsulphonic acid (prepared in accordance with the instructions of Examples 1 and 3 of the patent application WO 92/22911) in the melt and then 33 g of magnetizable pigment (type Bayferrox B 318 made by Bayer AG, Germany). The homogeneous melt is then cooled to a solid mass and ground and screened to give particles having a particle size of between 10 and 20 micrometers. The powder image formed with such toner powder on an image-recording medium 15 can then be transferred by pressure to a sheet of paper or other receiving material and then fixed thereon on by heating, e.g. using (weak) magnetron radiation. Of course other fixing methods known per se can be used.

The invention claimed is:

1. A method for operating an image-forming device, the image-forming device comprising:

an image-recording medium;

a toner supply roller arranged for supplying toner particles to the image-recording medium;

a developing element comprising a rotatable sleeve and an internal stationary magnet system generating a first magnetic field;

and a cleaning magnet system, configured to provide an activatable second magnetic field, the image-forming device being operable in a printing mode wherein the toner supply roller supplies toner particles to the image-recording medium, the rotatable sleeve rotates in a first direction so as to form a toner assembly in a developing zone by an interaction between the magnetically attractable toner particles and the first magnetic field generated by the stationary magnet system, while removing excessive toner and transporting the same back to the toner supply roller, and the image-recording medium forms a toner image on the image-recording medium in the developing zone by selectively electrically attracting toner particles onto the image-recording medium in accordance with a digital image pattern, the method comprising a step of switching the image-forming device into a cleaning mode, the cleaning mode comprising:

stopping the toner supply to the image-recording medium;

rotating the rotatable sleeve in a second direction, opposite to the first direction, such that the magnetically attractable toner particles are transported out of the developing zone towards the cleaning magnet system; and activating said second magnetic field so as to remove the transported magnetically attractable toner particles from the rotating rotatable sleeve of the developing element.

2. The method according to claim 1, wherein prior to rotating the rotatable sleeve in the second direction, the rotatable sleeve is rotated in the first direction during a pre-determined amount of time.

3. The method according to claim 1, wherein the second magnetic field is generated by positioning a movable arranged permanent magnet near the rotatable sleeve.

4. The method according to claim 1, wherein the second magnetic field is generated by activating an electro-magnetic activatable magnet system.

5. An image-forming device comprising:

an image-recording medium;

a toner supply roller arranged for supplying toner particles to the image-recording medium;

a developing element comprising a rotatable sleeve and an internal stationary magnet system generating a first magnetic field;

a cleaning magnet system, configured to provide an activatable second magnetic field;

and a controller configured to switch the image-forming device into a cleaning mode so as to stop the toner supply, to rotate the rotatable sleeve in a second direction and to activate the cleaning magnet system.

6. The image forming device according to claim 5, wherein the activatable cleaning magnet system comprises a moveable permanent magnet.

7. The image forming device according to claim 5, wherein the activatable cleaning magnet system comprises an electromagnet.

8. The image forming device according to claim 5, wherein the activatable cleaning magnet system and the developing element are arranged such that they are separated by a solid wall.

9. The image forming device according to claim 5, comprising a toner collecting bin.

* * * * *